US009358510B2

(12) United States Patent
Inoue et al.

(10) Patent No.: US 9,358,510 B2
(45) Date of Patent: Jun. 7, 2016

(54) PLANETARY MIXER

(71) Applicant: Inoue Mfg., Inc., Kanagawa (JP)

(72) Inventors: Masakazu Inoue, Tokyo (JP); Seiji Nagai, Kanagawa (JP); Tomoharu Kawahara, Kanagawa (JP)

(73) Assignee: INOUE MFG., INC. (JP)

( * ) Notice: Subject to any disclaimer, the term of this patent is extended or adjusted under 35 U.S.C. 154(b) by 443 days.

(21) Appl. No.: 13/895,711

(22) Filed: May 16, 2013

(65) Prior Publication Data

US 2014/0010041 A1 Jan. 9, 2014

(30) Foreign Application Priority Data

Jul. 5, 2012 (JP) ..... 2012-151528

(51) Int. Cl.

| | |
|---|---|
| ***B01F 7/00*** | (2006.01) |
| ***B01F 7/16*** | (2006.01) |
| ***B01F 7/30*** | (2006.01) |
| ***B01F 7/32*** | (2006.01) |

(52) U.S. Cl.

CPC ..... *B01F 7/00275* (2013.01); *B01F 7/161* (2013.01); *B01F 7/30* (2013.01); *B01F 7/32* (2013.01); *B01F 2215/0427* (2013.01)

(58) Field of Classification Search

CPC ..... B01F 7/00991; B01F 7/302; B01F 7/30; B01F 15/00707; B01F 7/16; B01F 7/00975; B01F 7/00208; B01F 7/14; B01F 7/00275

USPC ..... 366/287, 292, 318, 297, 288

See application file for complete search history.

(56) References Cited

U.S. PATENT DOCUMENTS

| | | | | | |
|---|---|---|---|---|---|
| 370,335 | A | * | 9/1887 | Hunter | 366/288 |
| 553,027 | A | * | 1/1896 | Eynon | 366/244 |
| 795,082 | A | * | 7/1905 | Warner | 366/244 |
| 984,079 | A | * | 2/1911 | Davis | 366/244 |
| 1,444,910 | A | * | 2/1923 | Goetz | 366/288 |
| 1,467,820 | A | * | 9/1923 | Trust et al. | 366/331 |
| 1,485,647 | A | * | 3/1924 | Ashley | 74/16 |
| 1,612,281 | A | * | 12/1926 | Goetz | 366/244 |
| 1,908,153 | A | * | 5/1933 | Meeker et al. | 74/341 |
| 2,622,856 | A | * | 12/1952 | Simon | 366/288 |
| 2,736,535 | A | * | 2/1956 | Hinkson et al. | 366/282 |
| 3,075,746 | A | * | 1/1963 | Yablonski et al. | 366/288 |
| 3,151,847 | A | * | 10/1964 | Broomall | 416/111 |
| 3,169,395 | A | * | 2/1965 | Enoch et al. | 73/169 |
| 3,224,744 | A | * | 12/1965 | Broomall | 366/288 |
| 3,358,971 | A | * | 12/1967 | Steinbock, Jr. | 366/139 |
| 3,393,900 | A | * | 7/1968 | Wagner et al. | 366/288 |
| 3,640,510 | A | * | 2/1972 | Lea | 366/139 |

(Continued)

FOREIGN PATENT DOCUMENTS

| | | |
|---|---|---|
| JP | 09267032 | 10/1997 |
| JP | 20002714764 | 10/2000 |

*Primary Examiner* — Tony G Soohoo
(74) *Attorney, Agent, or Firm* — Adams & Wilks

(57) ABSTRACT

A planetary mixer includes frame-shaped blades configured to undergo planetary motion within a tank having a generally cylindrical inner surface and a plate-shaped bottom surface including corners formed with a curved face throughout an entire circumference of the bottom surface. Each of the blades has a vertical side portion extending along the inner surface of the tank and a bottom side portion extending along the bottom surface of the tank and connected at generally right angles to lower ends of the vertical side portion to form blade corners each formed with a curved face.

20 Claims, 3 Drawing Sheets

(56) References Cited

U.S. PATENT DOCUMENTS

| | | | | | |
|---|---|---|---|---|---|
| 3,785,621 | A | * | 1/1974 | Hoskins | 366/288 |
| 3,903,957 | A | * | 9/1975 | Bremer | 165/92 |
| 4,032,117 | A | * | 6/1977 | Burgess | 366/304 |
| 4,057,226 | A | * | 11/1977 | de Mos et al. | 366/244 |
| 4,065,811 | A | * | 12/1977 | Pauty | 366/244 |
| 4,079,917 | A | * | 3/1978 | Popeil | 366/244 |
| 4,131,034 | A | * | 12/1978 | Rolf | 475/11 |
| 4,382,685 | A | * | 5/1983 | Pearson | 366/241 |
| 4,697,929 | A | * | 10/1987 | Muller | 366/97 |
| 4,704,035 | A | * | 11/1987 | Kowalczyk | 366/142 |
| 4,802,407 | A | * | 2/1989 | Negri et al. | 99/453 |
| 4,820,054 | A | * | 4/1989 | Wong | 366/287 |
| 5,028,141 | A | * | 7/1991 | Stiegelmann | 366/245 |
| 5,150,968 | A | * | 9/1992 | Inoue | 366/288 |
| 5,228,381 | A | * | 7/1993 | Virgilio et al. | 99/331 |
| 5,348,391 | A | * | 9/1994 | Murray | 366/139 |
| 5,535,665 | A | * | 7/1996 | Wong | 99/348 |
| 6,254,268 | B1 | * | 7/2001 | Long | 366/139 |
| 6,652,137 | B1 | * | 11/2003 | Bosch et al. | 366/288 |
| 6,994,465 | B2 | * | 2/2006 | Tague et al. | 366/139 |
| 2003/0103408 | A1 | * | 6/2003 | Foster | 366/139 |
| 2007/0064523 | A1 | * | 3/2007 | Wilson | 366/301 |
| 2009/0007820 | A1 | * | 1/2009 | Itoh et al. | 106/400 |
| 2009/0135666 | A1 | * | 5/2009 | Watano et al. | 366/98 |
| 2012/0213030 | A1 | * | 8/2012 | Cheung | 366/204 |
| 2013/0033958 | A1 | * | 2/2013 | Bravo | 366/272 |
| 2014/0010041 | A1 | * | 1/2014 | Inoue et al. | 366/287 |
| 2015/0231579 | A1 | * | 8/2015 | Inoue et al. | |

* cited by examiner

PLANETARY MIXER

BACKGROUND OF THE INVENTION

1. Field of the Invention

The present invention relates generally to mixers for processing materials in a multitude of fields such as chemistry, medicines, electronics, ceramics, foods, and feed. More specifically, the present invention relates to a planetary mixer in which multiple frame-shaped blades are configured to undergo planetary motion within a tank, such as a vessel or a stirring tank, by which solid/liquid type treatment materials can be subjected to various treatment operations, including blending, mixing, kneading, mixing and kneading, and dispersion treatments.

2. Background Information

Operations such as mixing, kneading, mixing and kneading, and dispersion treatments of solid/liquid type treatment materials, of from a low viscosity to a high viscosity up to 3,000 Pa·s regardless of the oiliness or aqueousness of the materials, have been mainly treated in a batch system by a planetary mixer in which plural frame-shaped or rectangularly shaped blades undergo orbital and rotary movement (i.e., planetary movement) within a tank. Such type of planetary mixer includes, for example, a biaxial mixer which has two frame-shaped or rectangularly shaped blades, a triaxial mixer which has three frame-shaped blades, a mixer having two frame-shaped blades and one turbine blade, or a quad axial mixer having two frame-shaped blades and two turbine blades.

During a mixing and kneading operation using the frame-shaped blades of a planetary mixer, dispersion is carried out by shearing stress applied by rotation of the blades to the treatment materials flowing between the blades and an inner wall of a tank. More specifically, the steps of this operation are conducted similarly to those for the operation of roll mills. Namely, when an edge portion formed on an outer side of a vertical side portion of the frame-shaped blade comes close to the inner wall of a tank, treatment materials entering a gap between the blade and the inner wall of the tank are compressed between the blade edge portion and the inner wall of the tank. Then, the treatment materials between the edge portion of the blade and the inner wall of the tank are subjected to shearing by the shearing stress generated by the rotation of the blade. Finally, when the edge portion of the blade moves away from the inner wall of the tank, the treatment materials are released and expand. Since the dispersion operation with the roll mill is conducted through each of compression, shearing, release and expansion steps, the step caused between the frame-shaped blade and the inner wall of the tank is considered the same as the dispersion step by the roll mill.

The frame-shaped blades and the tank are constructed in various fashions depending on the particular purpose. For example, as a frame member of a frame-shaped blade for the planetary mixer described in JP-A-2000-271464, the upper portion of a vertical side portion of the blade has a straight shape, the lower portion of the vertical side portion of the blade curves in an arcuate shape towards a bottom portion, and the curved portion is connected to a bottom side portion of a hemispherical frame member in series. In this frame member, a plate-shaped stirring tool is disposed. Further, the tank has a cylindrical side wall, and its bottom face has no corner with an acute angle, and the entire configuration of the tank is one which curves into a substantially bowl-like shape corresponding to the bottom side portion of the frame member. In JP-A-2000-271464, the bottom face of this tank is similar to that of a trough of a twin-barrel type kneader as viewed in cross-section.

In the case of a kneader, the trough is formed in a substantially box-like shape, the kneader blade extends in a horizontal direction along the bottom face of the trough, and the rotation of the kneader blade causes the treatment materials to flow towards a large arcuate face at the bottom of a tank. Accordingly, high viscosity treatment materials can be efficiently mixed and kneaded by compression, shearing and release of the treatment materials between the curved face of tank and the kneader blade similarly to the case relating to the operation of the roll mill.

On the other hand, in a case of the frame-shaped blades of the planetary mixer, the blade shaft extends in a direction substantially perpendicular to the bottom face of the tank and rotates in a circumferential direction of the tank. Therefore, the vertical side portion of the frame-shaped blade and the curved portion on the bottom side portion of the blade do not cause the treatment materials to flow towards the bottom face of the tank. Accordingly, the shearing force to be applied from the curved portion of the blade to the treatment materials is not sufficiently transmitted, and the shearing force per unit area is not sufficiently large. Accordingly, in a case of a planetary mixer in which the bottom side portion of the frame-shaped blade and the bottom face of the tank are formed in a large curved form as described above, it is difficult to apply a strong shearing action to the treatment materials throughout the entire tank, and this mixer is often used for stirring and blending treatment materials having a low viscosity.

In another planetary mixer described in JP-A-9-267032, a tank has a cylindrical side wall and a flat plate-like bottom part, and the corners of a bottom face of the tank are formed with a right angle. A frame-shaped blade has a straight, vertical side portion extending along the side wall of the tank, and a straight bottom side portion extending along the bottom plate of the tank and connected to a lower portion of the vertical side portion at a right angle. In this case, when the frame-shaped blade rotates, since an edge face formed on an outer side face of the vertical side portion of the blade moves in close to an inner wall of the tank, the treatment materials having a high viscosity are caused to flow between the edge face of the vertical side portion of the blade and the inner wall of the tank and are applied with shearing stress. At the same time, between the bottom side portion of the blade and the bottom face of the tank as well, the treatment materials entering the space between the bottom side portion of the blade and the bottom face of the tank are applied with shearing stress for dispersion treatment by orbital and rotary movement of the blades. As a result, it is possible to conduct efficient mixing and kneading of the high viscosity treatment materials within the tank. In such dispersion action, in the case of a batch system, the application of shearing stress to the treatment materials between the frame-shaped blade and the inner wall of the tank or the stirring tank is non-continuous. Furthermore, in a mixing and kneading machine of which the frame-shaped blades have a planetary motion track, the application of such shearing stress is two times per one rotation of the frame-shaped blade.

As described above, in order to effect the mixing and kneading action adequately throughout the tank between the inner face and the bottom face of the tank, it is preferred that the blade extend to such a position where its straight vertical side portion reaches close to the bottom face of the tank, the intersection of the vertical side portion and the bottom side portion of the blade is formed at a right angle, and the corner of the bottom face of the tank is also formed at a right angle as described in JP-A-9-267032. However, in such a structure, the flowability of the treatment materials is poor in the vicinity of the right angle corner on the bottom face of the tank. As the result, the shearing rate and shearing stress become uneven and the treatment materials tend to gather around the corners or the like of the tank, whereby material in the form of a powder at the time of charging of the treatment materials or material at the time of mixing and kneading tends to adhere or fix to the corners of the tank. Particularly, a situation where a treatment material having a high viscosity is subjected to strong kneading will be explained below.

In one example, as shown in FIG. 5A, some of the material, denoted by C, often adheres to the corner on the bottom face of a tank T or to the inner face of the bottom side portion of a blade B. Accordingly, it becomes necessary to stop the mixing and kneading operation to allow the adhered material (contamination) C to be scraped. If the mixing and kneading operation is continued without scraping the adhered material C, partial aggregate of powder, such as hard agglomerates, tends to result in a dilution step after strong kneading, and the agglomerates are incorporated during the dilution, thereby deteriorating the quality of the treatment materials subjected to the dispersion treatment.

As mentioned above, when the material adheres and fixes to the corners at both ends of the bottom side portion of the frame-shaped blade and the corners on the bottom face of the tank, it is required to stop the mixing and kneading operation and to scrape the adhered material on the blade or the inner bottom portion of the tank. Not only is such scraping operation by workers dangerous, particularly in a case of the material adhered or fixed to the corners on the bottom face of the tank, but the scraping operation is also difficult and cumbersome, whereby hard agglomerates are likely to be incorporated during the dilution. Furthermore, since such scraping operation is necessarily conducted during the mixing and kneading operation, the mixing and kneading operation cannot be continuously carried out. Additionally, since an opening portion of the tank is opened during the scraping operation, it becomes impossible to tightly close the tank until completion of the mixing and kneading operation. In a case where a volatile organic solvent is used for the mixing and kneading operation, problems of environmental pollution may sometimes be caused by opening the tank.

SUMMARY OF THE INVENTION

It is an object of the present invention to provide a planetary mixer in which frame-shaped planetary blades are configured to undergo planetary motion within a tank for efficiently subjecting solid/liquid type treatment materials to various treatment operations, including blending, mixing, kneading, mixing and kneading, and dispersion treatments.

It is another object of the present invention to provide a planetary mixer capable of dispersing and kneading materials efficiently by applying a shearing force to the materials between the blades and the inner wall of the tank.

It is yet another object of the present invention to provide a planetary mixer in which sufficient and uniform shearing stress can be applied at a constant shearing rate by the blades to treatment materials throughout the circumference of corners on a bottom inner face of the tank to prevent the materials from being adhered or fixed to the blades and to and around the corners of the tank.

It is still another object of the present invention to provide a planetary mixer by which no scraping of materials within the tank is required during operation of the planetary mixer, thereby improving safety, shortening treatment times for mixing and/or kneading, and improving the overall productivity of the planetary mixer without formation of hard agglomerates.

The foregoing and other objects of the present invention are carried out by a planetary mixer for subjecting solid/liquid type treatment materials to various types of treatment operations, including blending, mixing, kneading, mixing and kneading, and dispersion treatments. The planetary mixer includes frame-shaped or rectangularly shaped blades each configured to undergo planetary motion (i.e., rotation and revolving movement around a drive shaft) within a tank to subject the materials to a treatment operation. Each of the blades has a vertical side portion and a bottom side portion, and is configured to undergo planetary motion in a tank having corners formed on the entire circumference of a bottom face of the tank. During operation of the planetary mixer according to the present invention, shearing stress is applied to treatment materials between the vertical side portion of the blade and an inner face of the tank and between the bottom side portion of the blade and the bottom face of the tank so that the materials being treated are not allowed to adhere or become fixed to corners on the bottom face of the tank and to corners at both ends of the bottom side portion of each blade.

According to an embodiment of the present invention, the bottom face of the tank has a flat plate shape and the inner face of the tank has a cylindrical shape. The vertical side portion of each blade extends straight along the inner face of the tank and the bottom side portion of each blade extends straight along the bottom face of the tank. The vertical side portion and the bottom side portion of the blade are connected at a right angle at such a position in the vicinity of corners on the bottom face of the tank. The corners at connecting portions at both ends of the blade are formed to have a small curved face, and the corners on the bottom face of the tank are formed to have a curved face in its entire circumference. By this construction, uniform shearing stress can be applied at a constant shearing rate to treatment materials throughout the circumference of the corners on the bottom face of the tank.

According to the present invention, at an outer face of the vertical side portion of each frame-shaped blade, a narrow edge portion is formed, and the width of this edge portion is is formed in a size in proportion to a radius of curvature of the curved face of the corners on the bottom face of the tank. Namely, the radius of curvature of the curved face at the corners on the bottom face of the tank is formed to be about 2 to 4 times the width of the edge portion of the blade. Preferably, the radius of curvature is about 2 mm to about 15 mm, and more preferably about 3 mm to about 10 mm, by which excellent processing (e.g., mixing and kneading) results can be obtained.

According to the above structure of the present invention, when the frame-shaped blades undergo planetary motion within the tank, the edge portion formed on the outer face of the vertical side portion of the blade rotates close to the inner face of the tank. By this operation, the materials flowing between the blade and the inner face of the tank are caused to enter a gap between the edge portion of the blade and the inner face of the tank and, at the same time, are subjected to mixing, mixing and kneading, or the like by the shearing stress generated by the rotation of the blade, and when the vertical side portion of the blade moves away from the inner face of the tank, the materials expand. On the other hand, the materials entering a gap between the bottom side portion and the bottom face of the tank are substantially similarly subjected to processing (e.g., mixing, kneading or mixing and kneading), and such processing action is conducted in the tank in its entirety throughout the whole length of the vertical side portion and the bottom side portion. In this instance, since the corners on the bottom face of the tank are formed to have a curved face over its entire circumference, the flowability at the corners on the bottom face of the tank is not prevented, uniform shearing stress can be applied at a constant shearing rate to the treatment materials over the entire circumference of the tank, and there is no concern that the materials will adhere or be fixed to the corners or the like on the bottom face of the tank.

Thus, during operation of the planetary mixer, when the blades rotate, the materials flowing in the tank flow without backwater even in the vicinity of corners on the bottom face of the tank, uniform shearing stress can be applied at a constant shearing rate to conduct dispersion, and it is possible to prevent adherence and fixing of the materials to the tank and blades.

By the foregoing structural arrangement of the planetary mixer according to the present invention, scraping of materials that conventionally adhere or fix to the blades or to corners on the bottom face of the tank is no longer required during operation of the planetary mixer. As a result, operational safety is achieved. Furthermore, problems associated with such adhered or fixed materials being incorporated in the form of hard agglomerates into the remaining materials being processed are obviated, whereby it becomes possible to produce a paste with excellent properties in a short period of time and to improve of operability of the planetary mixer.

Additionally, since there is no need to conduct a scraping operation during operation of the planetary mixer, it becomes possible to conduct the processing operation (e.g., mixing and/or kneading) of the planetary mixer continuously in such a state that the tank is tightly closed and without interrupting the processing operation. Further, even if materials containing a volatile organic substance are used, environmental pollution problems are avoided, the flowability of the materials can be improved even at the time of dilution, and homogeneity can be achieved.

According to the present invention, the instant inventors have discovered through experimentation that efficient processing (e.g., mixing and/or kneading) of the materials can be particularly achieved when the radius of curvature of the curved face at the corners on the bottom face of the tank is preferably set to be about 2 mm to about 15 mm, and more preferably about 3 mm to about 10 mm. Namely, when the radius of curvature is set to be less than 2 mm, the corner on the bottom face of the tank forms a nearly right angle, and the shearing stress cannot reach the deep part of the corners and the mixing and kneading materials may sometimes be locally adhered or fixed. Further, when the curved face at the corners on the bottom face of the tank is part of an arc, the length of the arc of the curved face corresponds to the length of one fourth of the entire circumference of a circle having the same radius as the radius of curvature of the curved face, whereby if the radius of curvature exceeds 15 mm, the curved face to which the corner of the blade comes close is substantially widened. Accordingly, the shearing stress per unit area to be applied to the materials gathered around the corners on the bottom face of the tank via the edge portion formed on the outer face of the blade becomes insufficient, whereby insufficient processing (e.g., mixing and kneading or dispersion) of the treatment materials is brought about and hard agglomerate may sometimes be incorporated in the materials, thereby degrading the overall quality of the materials.

According to experiments conducted by the instant inventors, superior benefits are achieved by forming a curved face at the corners at both ends of the bottom side portion of the frame-shaped blade and the corners on the bottom face of the tank. The inventors have found that when no curved face is formed at the corners at both ends of the bottom side portion of the frame-shaped blade and the corners on the bottom face of the tank, the materials tended to adhere to the corners on the bottom face of the tank. When a curved face is formed only on the blade side, the adhered materials could be observed at the corner on the bottom face of the tank. When the curved face is formed only at the side of the corners of the bottom face of the tank, the materials were observed to adhere and be fixed on the frame-shaped blade. In these cases, it is considered that adherence and fixing of the materials are caused because the opposing distance between the corners at both ends on the bottom side portion of the frame-shaped blade and the corners on the bottom face of the tank is not constant and, as a result, a uniform shearing stress cannot be applied to the materials at a constant shearing rate.

In contrast, when small curved faces are provided at corners at both ends of the bottom side portion of the frame-shaped blade and at corners on the bottom face of the tank, the distance between them became constant, and sufficient and uniform shearing stress can be applied to the materials at a constant shearing rate. As a result, the materials being processed do not adhere and/or fix on the blade and/or the tank, and excellent processing results can obtained as compared to the conventional art.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings:

FIGS. 5A-5C are explanatory views showing the relation between a corner of a bottom side portion of a blade and a bottom corner of a tank, wherein FIG. 5A shows a case where no curved face is formed at the corner of the bottom side portion of the blade and a bottom corner of a tank, FIG. 5B shows a case where a curved face is formed only at the corner of the bottom side portion of the blade, and FIG. 5C shows a case where a curved face is formed only at a bottom corner of a tank.

DETAILED DESCRIPTION OF THE PREFERRED EMBODIMENTS

While this invention is susceptible of embodiments in many different forms, this specification and the accompanying drawings disclose only presently preferred embodiments of the invention. The invention is not intended to be limited to the embodiments so described, and the scope of the invention will be pointed out in the appended claims.

The planetary mixer according to the present invention provides multiple frame-shaped blades configured to undergo planetary motion within a tank, such as a vessel or a stirring tank, by which solid/liquid type treatment materials can be subjected to various treatment operations, including blending, mixing, kneading, mixing and kneading, and dispersion treatments. The planetary mixer of the present invention may be used in the production of various products in a multitude of fields such as chemistry, medicines, electronics, ceramics, foods, feed, etc.

Figure 1:
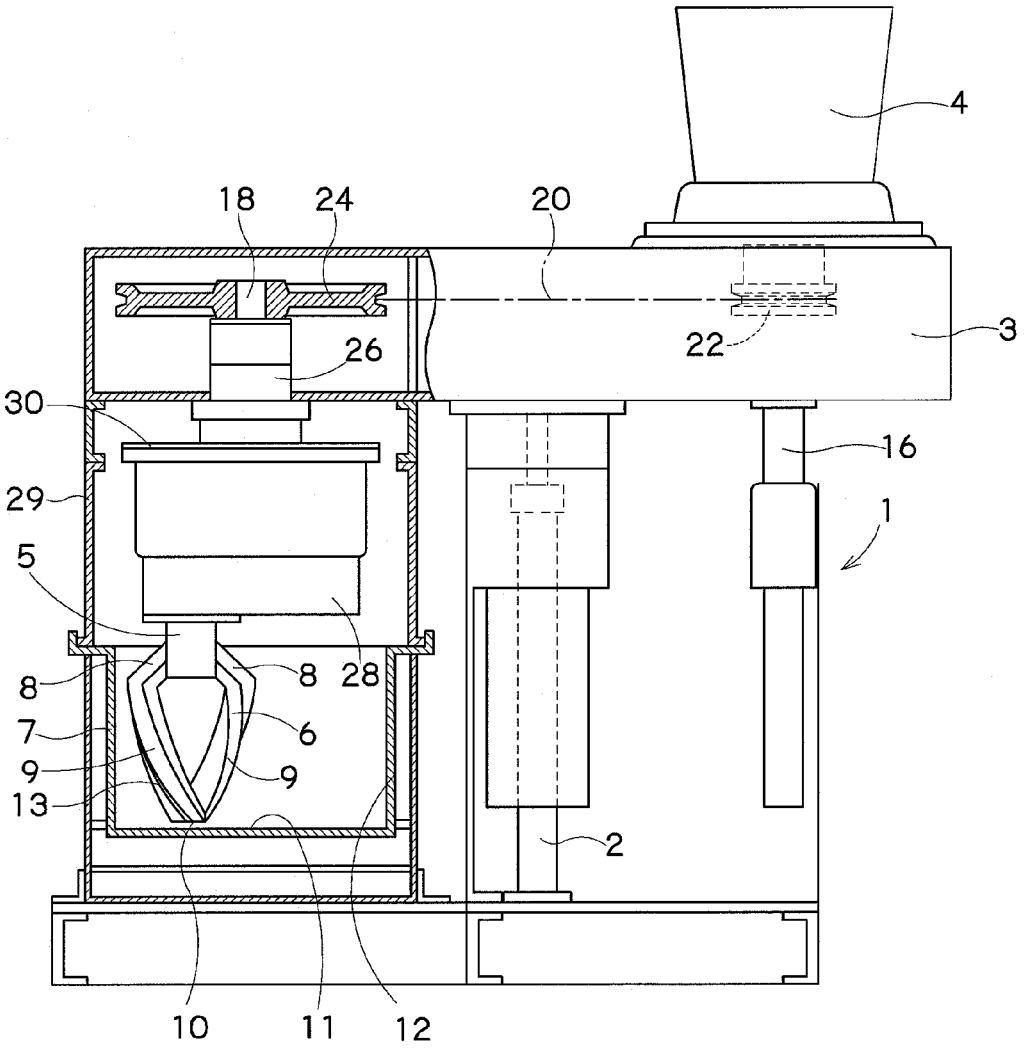
FIG. 1 is a front view, partially cutaway, of a planetary mixer according to a first exemplary embodiment of the present invention.

Referring first to FIG. 1 which is an elevational view of a planetary mixer according to the present invention, a main body 1 has an agitating or stirring head 3 disposed over a tank (vessel or stirring tank) 7. The stirring head 3 is guided by a guide rod 16 and vertically moved (up and down) by a lifting cylinder (e.g., hydraulic cylinder) 2. Alternatively, the planetary mixer could be configured so that the tank 7 may be moved upward and downward below the stirring head by a lifting cylinder (not shown) while the stirring head remains fixed (i.e., in a non-movable state). The stirring head 3 is also fitted with drive means 4, such as a driving motor, for rotating a drive shaft 18. The transmission mechanism between the motor and the drive shaft may be configured in various ways such as shown in FIG. 1, for example, to use a chain 20 for connecting a drive sprocket 22 formed on a shaft of the motor 4 with a driven sprocket 24 on the drive shaft 18.

The drive shaft 18 extends through a support cylinder 26 integrally mounted to the stirring head 3. A rotary body 28 is integrally mounted (e.g., with a key) with a trailing end of the drive shaft 18. The outer periphery of the rotary body 28 is enclosed with a cover 29. The peripheral edge of the rotary body 28, which is cylindrical in configuration, is extended upward and screwed in a rotatable cover plate 30 that is put on the support cylinder 26. Multiple driven (stirring) shafts 5 are rotatably carried by the rotary body 28 in such a way so as to surround the drive shaft 18. A frame-shaped or rectangularly-shaped blade 6 (agitating blade) is integrally mounted (e.g., with a key) to a lower or trailing end of each of the stirring shafts 5 to cause the blades 6 to move in close proximity to the inner wall of the tank 7. In FIG. 1, only one stirring shaft 5 and one corresponding blade 6 are shown to facilitate understanding of the planetary mixer shown in the figure. However, it is understood that the planetary mixer of the present invention includes a plurality of stirring shafts and corresponding blades such as, for example, two or three, or any other suitable number.

Figure 2:
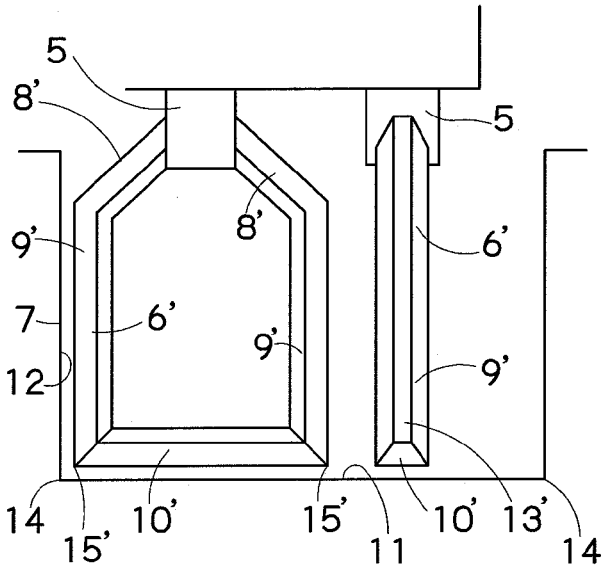
FIG. 2 is an explanatory view showing a frame-shaped blade according to a second exemplary embodiment of the present invention and illustrating the relation between the frame-shaped blade and the tank.
Figure 3:
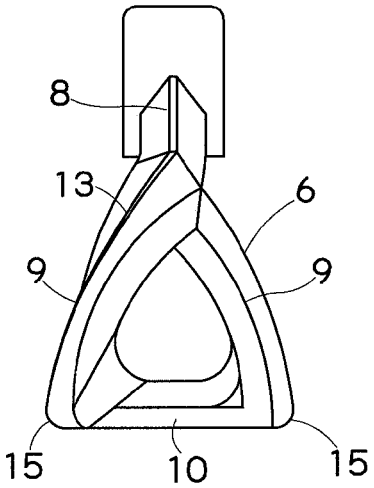
FIG. 3 is a front view showing the frame-shaped blade according to the first exemplary embodiment of the invention.

FIGS. 1-3 illustrate two different embodiments of the frame-shaped blades according to the present invention, with the corresponding parts of the blades being depicted by the same reference numbers, with the exception that the reference numbers for the parts of the blade in FIG. 2 are denoted with a prime (') symbol. The tank 7 has the same construction whether it is used with the blade shown in FIGS. 1, 3 or with the blade shown in FIG. 2. As shown in FIG. 2, the tank 7 is generally cylindrical in shape and has a flat, plate-like bottom face (surface) 11 and a cylindrical inner face (surface) 12. The volumetric capacity of the tank 7 may range from a small volume of about 0.2 liter to a large volume of about 340 liters.

In the embodiment shown in FIGS. 1 and 3, the blade 6 is in the form of a frame-shaped twisted blade having an upper side portion 8 which is connected to a corresponding stirring shaft 5, a vertical side portion 9 which is connected to both ends of the upper side portion 8, and a bottom side portion 10 which is connected to the lower end of the vertical side portion 9 at a right angle. In the blade 6, the upper side portion 8 and the bottom side portion 10 extend along different directions and are disposed at a predetermined angle of, for example, 45° or 90° or greater. The frame-shaped twisted blade 6 is formed by twisting the vertical side portion 9 90° about a vertical axis relative to the bottom side portion 10.

In the embodiment shown in FIG. 2, the blade 6' has an upper side portion 8' which is connected to a corresponding stirring shaft 5, a vertical side portion 9' which is connected to both ends of the upper side portion 8', and a bottom side portion 10' which is connected to the lower end of the vertical side portion 9' at a right angle. In the blade 6', the upper side portion 8' and the bottom side portion 10' are arranged in the same direction.

Referring to FIGS. 1 and 3, the vertical side portion 9 of the frame-shaped blade 6 is formed straight along the inner face 12 of the tank 7 while twisting downward. On an outer face (surface) of the vertical side portion 9, a narrow-width edge portion 13 is formed. The bottom side portion 10 connected to both lower ends of the vertical side portion 9 is formed straight along the bottom face 11 of the tank 7. The width of the edge portion 13 is preferably about 2 mm to about 6.5 mm although it depends on the size of the tank or the required operating power.

Referring to FIG. 2, the vertical side portion 9' of the frame-shaped blade 6' extends straight along the inner face 12 of the tank 7. On the outer face of the vertical side portion 9', a narrow-width edge portion 13' is formed. The bottom side portion 10' connected to both lower ends of the vertical side portion 9' is formed straight along the bottom face 11 of the tank 7. The width of the edge portion 13' is also preferably about 2 mm to about 6.5 mm depending on the size of the tank or the required operating power.

Figure 4:
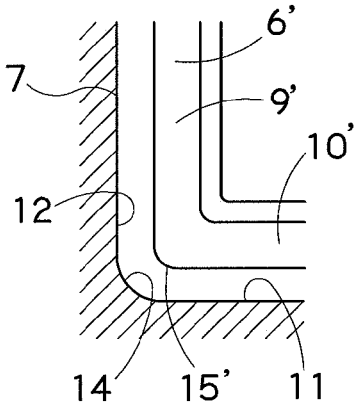
FIG. 4 is an enlarged explanatory view showing an example of a tank and a blade of the present invention.

FIG. 4 is an explanatory view showing a partially enlarged view of the tank 7 and the blade 6' of the present invention. While the following description of the features in the configuration shown FIG. 4 is made in connection with the blade 6' shown in FIG. 2, the same description and corresponding features apply to the blade 6 shown in FIGS. 1 and 3.

As shown in FIG. 4, a small curved face is formed at a corner 14 on the bottom face of the tank 7 and at corners 15' at both ends of the blade 6'. Each of the corners 15' of the blade 6' corresponds to a front end of a connecting portion between the vertical side portion 9' and the bottom side portion 10' of the blade 6'. By this construction, the flowability of the materials during a processing operation can be improved at the corners on the bottom face of the tank 7 along its entire circumference and sufficient shearing force can be applied from the edge portion of the blade 6' to the materials.

Preferably, the radius of curvature of the curved face at the corners 14 on the bottom face of the tank 7 is formed to be about 2 mm to about 15 mm, and more preferably about 3 mm to about 10 mm. By this construction, highly uniform shearing stress can be applied to the materials, resulting in a highly efficient processing (e.g., mixing and kneading) operation. The instant inventors have discovered through experimentation that when the radius of curvature is set to be less than 2 mm, the corners 14 on the bottom face of the tank 7 forms a nearly right angle, and the shearing stress cannot reach the deep part of the corners and the materials may sometimes be locally adhered or fixed. Further, when the curved face at the corners 14 is part of an arc, the length of the arc of the curved face corresponds to the length of one fourth of the entire circumference of a circle having the same radius as the radius of curvature of the curved face, whereby if the radius of curvature exceeds 15 mm, the curved face to which the corner of the blade comes close is substantially widened. Accordingly, the shearing stress per unit area to be applied to the materials gathered around the corners 14 on the bottom face of the tank 7 via the edge portion formed on the outer face of the blade becomes insufficient, whereby insufficient processing (e.g., mixing and kneading or dispersion) of the materials is brought about and hard agglomerates may sometimes be incorporated in the materials, thereby degrading the overall quality of the materials.

Furthermore, it was also found from experiments that excellent results can be obtained when the radius of curvature of the curved face at the corners 14 on the bottom face of the tank 7 is formed in a size proportional to the size of the width of the edge portions 13, 13' of the blades 6, 6', respectively, and the best results can be obtained when such radius of curvature is preferably about 2 to 4 times, and more preferably about 3 times, the edge width. Alternatively, the radius of curvature of the corners at both ends of the bottom side portions of the blade and the curved face formed at the corners on the bottom face of the tank may be the same. However, the radius of curvatures of the curved face formed on the tank and the curved face formed at both ends of the blade may appropriately be changed depending on the driving force of the blade. For example, the radius of curvature at the tank side may be formed larger than the radius of curvature at the blade side.

The benefits achieved by forming a curved face at the corners at both ends of the bottom side portion of the frame-shaped blade and the corners on the bottom face of the tank are described below with reference to the configurations shown in FIGS. 4 and 5A-5C.

Figure 5A:
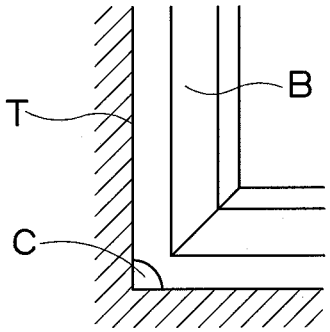
Figure 5B:
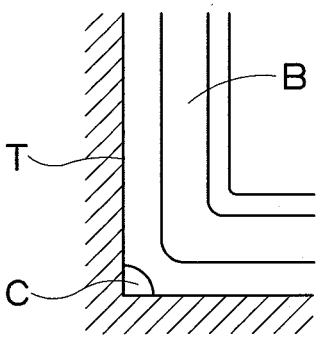
Figure 5C:
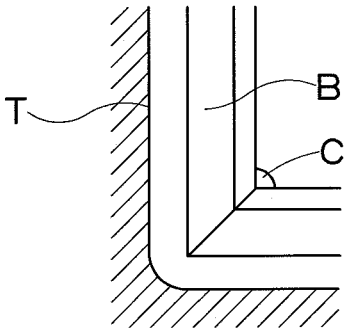

According to experiments conducted by the instant inventors, when no curved face is formed at the corners at both ends of the bottom side portion of the frame-shaped blade B and the corners on the bottom face of the tank T (FIG. 5A), the materials tended to adhere to the corners on the bottom face of the tank as denoted at C. As shown in FIG. 5B, when a curved face is formed only on the blade B side, the adhered materials C were observed at the corner on the bottom face of the tank T. As shown in FIG. 5C, when the curved face is formed only at the side of the corner of the bottom face of the tank T, the materials were observed to adhere and be fixed on the frame-shaped blade B. In these cases, it is considered that adherence and fixing of the materials are caused because the opposing distance between the corners at both ends on the bottom side portion of the frame-shaped blade and the corners on the bottom face of the tank is not constant, and a uniform shearing stress cannot be applied to the materials at a constant shearing rate.

In contrast, as shown in FIG. 4, when small curved faces are provided at corners 15' at both ends of the bottom side portion of the frame-shaped blade 6' and at corners 14 on the bottom face of the tank 7, the distance between them became constant, and uniform shearing stress was applied to the materials at a constant shearing rate. As a result, the materials being processed do not adhere and/or fix on the blade and/or the tank, and excellent processing results are obtained as compared to the configurations shown in FIGS. 5A-5C.

With reference to FIGS. 2 and 4, when the materials are placed into the tank 7 with the stirring head 3 lowered, each blade 6' rotates on the axis of the driven stirring shaft 5 and simultaneously revolves around the drive shaft 18, i.e., the blades 6' undergo a planetary motion. In this state, the edge portion 13' formed on the outer face of the vertical side portion 9' of the blade 6' rotates in close proximity to the inner face of the tank 7. As the blades 6' conduct the planetary motion in close proximity to the inner face of the tank 7, a strong shearing force is applied to the materials between the blades and the inner face of the tank and between the blades. As a result, the materials flowing between the blade 6' and the inner face of the tank 8 are caused to enter a gap between the edge portion 13' of the blade 6' and the inner face of the tank 7 and, at the same time, are satisfactorily dispersed, agitated, kneaded and the like. When the vertical side portion 9' of the blade 6' thereafter moves away from the inner face of the tank 7, the materials expand. On the other hand, the materials entering a gap between the bottom side portion 10' and the bottom face 11 of the tank are substantially similarly subjected to processing (e.g., mixing, kneading or mixing and kneading), and such processing action is conducted in the tank 7 in its entirety throughout the whole length of the vertical side portion 10' and the bottom side portion 11. In this instance, since the corners 14 on the bottom face 11 of the tank 7 are formed to have a curved face over its entire circumference, the flowability at the corners 14 is not prevented, uniform shearing stress can be applied to the materials at a constant shearing rate over the entire circumference of the tank 7, and there is no concern that the materials will adhere or be fixed to the corners 14 or the like on the bottom face 11 of the tank 7.

Since the materials are prevented from adhering or being fixed to the corners 14 on the bottom face 11 of the tank 7, an operation for scraping such adhered or fixed materials is obviated. As a result, not only is operational safety achieved, but there is no need to interrupt the processing of the materials to perform a scraping operation, and the materials can be processed efficiently in a continuous manner and without any interruptions.

The planetary mixer according to the present invention is used for various applications as described above. In a typical processing operation, the treatment materials are first subjected to a powder mixing method in which a powder is charged when the materials are supplied, and then a small amount of a liquid component is added to the obtained powder and material to conduct a surface treatment of the powder and material, resulting in deactivation of the powder and the material and crashing of aggregates. Thereafter, a small amount of a liquid component is further added, and strong kneading is conducted by a high shearing operation in a high viscosity state using the planetary mixer according to the present invention as described above. Finally, the resulting product is diluted and taken out in the form of a paste. Since the shearing stress is represented by the product of the material's viscosity and the shearing rate and a high shearing force can be obtained by the strong kneading in a high viscosity state, it is preferred to conduct the strong kneading as described above.

As set forth above, the materials are subjected to a strong kneading operation using the planetary mixer according to the present invention. It is preferred to conduct the operation under such conditions that the turning or rotating speed is about 0.5 to 1.5 m/sec and the temperature is at most about 60° C. so as not to cause deterioration of properties by heat generation of the paste at the time of mixing and kneading. When the turning speed is 1.5 m/sec or higher, a large amount of heat is generated, and from the aspect of material properties, it becomes difficult to maintain the temperature of the material at 60° C. or lower.

The process from the charge of the material powder as described above to the dilution to form a paste was carried out using the planetary mixer according to the present invention in the form of a triaxial planetary mixer having a tank with a volume of 15 liters, manufactured by INOUE MFG., Inc. Even near the corners on the bottom face of the tank, a uniform shearing stress was applied to the materials at a constant shearing rate and it was possible to obtain a paste without any types of agglomerates and to conduct the dispersion treatment (e.g., mixing, kneading, mixing and kneading)

efficiently. Further, the materials flowed continuously along the curved face corner at both ends of the blade and the curved face corners on the bottom face of the tank without causing any backwater. The improvement in flowability made it possible to avoid the adherence or fixing of materials to the inner face of the blade and the corners on the bottom face of the tank that have been conventionally experienced. As a result, no scraping operation was required by workers during the operation of the planetary mixer.

It will be appreciated from the foregoing description that the present invention provides a planetary mixer in which frame-shaped planetary blades undergo planetary motion within a tank to efficiently subjecting solid/liquid type treatment materials to various treatment operations, including blending, mixing, kneading, mixing and kneading, and dispersion treatments. The frame-shaped planetary blades are capable of dispersing and kneading the materials efficiently by applying a shearing force to the materials between the blades and the inner wall of the tank. Sufficient and uniform shearing stress can be applied at a constant shearing rate by the blades to materials throughout the circumference of corners on a bottom inner face of the tank to prevent the materials from being adhered or fixed to the blades and to and around the corners on the bottom face of the tank.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

What is claimed is:

1. A planetary mixer comprising:

a tank having a generally cylindrical inner surface and a plate-shaped bottom surface including corners formed with a curved face throughout an entire circumference of the bottom surface; and a plurality of blades each having a vertical side portion extending along and disposed at a first constant distance from the inner surface of the tank and a bottom side portion extending along and disposed at a second constant distance from the bottom surface of the tank and connected at generally right angles to lower ends of the vertical side portion to form corners of the blade, each of the blade corners being formed with a curved face configured to be disposed at a third constant distance from the curved faces of the corners at the bottom surface of the tank, the first, second and third constant distances being equal to one another.

2. A planetary mixer according to claim 1; wherein an outer surface of the vertical side portion of each of the blades has a narrow edge portion; and wherein the curved face at the corners on the bottom surface of the tank has a radius of curvature of 2 to 4 times a width of the narrow edge portion.

3. A planetary mixer according to claim 1; wherein an outer surface of the vertical side portion of each of the blades has a narrow edge portion; and wherein the radius of curvature of the curved face at the corners on the bottom surface of the tank is 3 times the width of the narrow edge portion.

4. A planetary mixer according to claim 1; wherein each of the curved faces at the corners of each of the blades and at the corners on the bottom surface of the tank has a radius of curvature in the range of about 2 mm to about 15 mm.

5. A planetary mixer according to claim 1; wherein each of the curved faces at the corners of each of the blades and at the corners on the bottom surface of the tank has a radius of curvature in the range of about 3 mm to about 10 mm.

6. A planetary mixer according to claim 1; wherein each of the blades is frame-shaped.

7. A planetary mixer according to claim 1; wherein each of the blades is rectangular-shaped.

8. A planetary mixer according to claim 1; wherein each of the blades comprises a frame-shaped twisted blade.

9. A planetary mixer according to claim 8; wherein for each of the blades, the vertical side portion is twisted 90° about a vertical axis relative to the bottom side portion.

10. A planetary mixer comprising:

a tank configured to receive solid/liquid type treatment materials, the tank having a generally cylindrical inner surface and a plate-shaped bottom surface including corners formed with a curved face throughout an entire circumference of the bottom surface;

a rotationally driven drive shaft;

a rotary body connected to the drive shaft for rotation therewith;

a plurality of driven shafts rotatably carried by the rotary body; and a plurality of blades each having a vertical side portion extending along and disposed at a first constant distance from the inner surface of the tank and a bottom side portion extending along and disposed at a second constant distance from the bottom surface of the tank and connected at generally right angles to lower ends of the vertical side portion to form corners each formed with a curved face configured to be disposed at a third constant distance from the curved faces of the corners at the bottom surface of the tank, the first, second and third constant distances being equal to one another, and each of the blades being connected to one of the driven shafts to undergo planetary motion within the tank in close proximity to the inner and bottom surfaces of the tank to generate a shearing force that is applied to the materials between the blades and the inner and bottom surfaces of the blade and between the blades themselves so that the materials are not allowed to adhere to the corners of the blades and to the corners at the bottom surface of the tank.

11. A planetary mixer according to claim 10; wherein an outer surface of the vertical side portion of each of the blades has a narrow edge portion; and wherein the curved face at the corners on the bottom surface of the tank has a radius of curvature of 2 to 4 times a width of the narrow edge portion.

12. A planetary mixer according to claim 10; wherein an outer surface of the vertical side portion of each of the blades has a narrow edge portion; and wherein the radius of curvature of the curved face at the corners on the bottom surface of the tank is 3 times the width of the narrow edge portion.

13. A planetary mixer according to claim 10; wherein each of the curved faces at the corners of each of the blades and at the corners on the bottom surface of the tank has a radius of curvature in the range of about 2 mm to about 15 mm.

14. A planetary mixer according to claim 10; wherein each of the curved faces at the corners of each of the blades and at the corners on the bottom surface of the tank has a radius of curvature in the range of about 3 mm to about 10 mm.

15. A planetary mixer according to claim 10; wherein each of the blades is frame-shaped.

16. A planetary mixer according to claim 10; wherein each of the blades is rectangular-shaped.

17. A planetary mixer according to claim 10; wherein each of the blades comprises a frame-shaped twisted blade.

18. A planetary mixer according to claim 17; wherein for each of the blades, the vertical side portion is twisted 90° about a vertical axis relative to the bottom side portion.

19. A planetary mixer comprising:

an agitating head located above a tank configured to receive solid/liquid type treatment materials, the tank having a generally cylindrical inner surface and a plate-shaped bottom surface including corners formed with a curved face throughout an entire circumference of the bottom surface;

a rotationally driven drive shaft extending downwardly from the agitating head;

a rotary body connected to the drive shaft for rotation therewith;

a plurality of driven shafts rotatably carried by the rotary body; and a plurality of agitating blades each having a vertical side portion extending along and disposed at a first constant distance from the inner surface of the tank and a bottom side portion extending along and disposed at a second constant distance from the bottom surface of the tank and connected at generally right angles to lower ends of the vertical side portion to form corners each formed with a curved face configured to be disposed at a constant distance from the curved faces of the corners at the bottom surface of the tank, the first, second and third constant distances being equal to one another, and each of the agitating blades being connected to one of the driven shafts for undergoing rotational movement on the axis of the corresponding driven shaft while simultaneously undergoing revolving movement around the drive shaft to generate a shearing force that is applied to the materials contained in the tank so that the materials are not allowed to adhere to the corners of the blades and to the corners at the bottom surface of the tank.

20. A planetary mixer according to claim 19; wherein an outer surface of the vertical side portion of each of the agitating blades has a narrow edge portion, the curved face at the corners on the bottom surface of the tank having a radius of curvature of 2 to 4 times a width of the narrow edge portion; and wherein each of the curved faces at the corners of each of the agitating blades and at the corners on the bottom surface of the tank has a radius of curvature in the range of about 2 mm to about 15 mm.

* * * * *